US011382373B2

(12) United States Patent
Buell

(10) Patent No.: US 11,382,373 B2
(45) Date of Patent: Jul. 12, 2022

(54) MEN'S OR WOMEN'S TRUE-FITTING CONTOUR SUPPORT WAIST BELT

(71) Applicant: Russell Buell, Earlville, NY (US)

(72) Inventor: Russell Buell, Earlville, NY (US)

( * ) Notice: Subject to any disclaimer, the term of this patent is extended or adjusted under 35 U.S.C. 154(b) by 137 days.

(21) Appl. No.: 16/722,029

(22) Filed: Dec. 20, 2019

(65) Prior Publication Data

US 2020/0205496 A1 Jul. 2, 2020

Related U.S. Application Data

(60) Provisional application No. 62/787,487, filed on Jan. 2, 2019.

(51) Int. Cl.
*A41F 9/00* (2006.01)

(52) U.S. Cl.
CPC ..... *A41F 9/002* (2013.01)

(58) Field of Classification Search
CPC ..... A41F 9/002; A61F 5/02; A41D 13/0531
See application file for complete search history.

(56) References Cited

U.S. PATENT DOCUMENTS 2,733,712 A * 2/1956 Wuesthoff ..... A61F 5/028 602/19
3,171,409 A * 3/1965 Cetrone ..... A61F 5/028 128/99.1
3,315,670 A * 4/1967 Fumea ..... A41C 1/10 128/95.1
4,159,020 A * 6/1979 von Soiron ..... A61F 5/26 601/1
4,348,774 A * 9/1982 Woodson ..... A41F 9/002 128/95.1
4,991,573 A * 2/1991 Miller ..... A61F 5/028 128/106.1
5,105,806 A * 4/1992 Woodhouse ..... A61F 5/028 128/112.1
5,122,111 A * 6/1992 Sebastian ..... A61F 5/028 128/108.1
5,195,948 A * 3/1993 Hill ..... A61F 5/028 602/19
5,429,587 A * 7/1995 Gates ..... A61F 5/028 128/876
5,651,763 A * 7/1997 Gates ..... A61F 5/028 128/876
D550,847 S * 9/2007 Kixmiller ..... D24/190
D554,268 S * 10/2007 Harding ..... D24/190
7,364,558 B2 * 4/2008 Weaver, II ..... A61F 5/028 297/230.1
D655,821 S * 3/2012 Matsuo ..... D24/206
(Continued)

*Primary Examiner* — Richale L Quinn
(74) *Attorney, Agent, or Firm* — Bernhard P. Molldrem, Jr.

(57) ABSTRACT

A waist belt for use with pants, trousers, jeans, or slacks has contour support portions formed or attached at locations that correspond to front and back recesses in the human body at the waist line. Favorably there is a back support portion to be located at the small of the back and left and right support portions at locations where the torso meets the respective upper legs. These can be of a length and thickness for the given wearer and positioned on the inside surface of the belt strap portion for the wearer to provide a custom fit. These may be formed with the belt strap, affixed to the strap or repositionably attached, e.g., with buttons, snaps or Velcro or another hook-loop system.

16 Claims, 4 Drawing Sheets

(56) References Cited

U.S. PATENT DOCUMENTS

| | | | | |
|---|---|---|---|---|
| 8,900,169 | B2 * | 12/2014 | Smith | A61B 5/6804 601/134 |
| 10,327,977 | B2 * | 6/2019 | Julian | A61H 7/001 |
| 11,033,416 | B1 * | 6/2021 | Smith, III | A61F 5/028 |
| 2014/0135673 | A1 * | 5/2014 | Cohen | A61F 5/30 602/19 |

* cited by examiner

MEN'S OR WOMEN'S TRUE-FITTING CONTOUR SUPPORT WAIST BELT

Applicant claims priority under 35 U.S.C. § 119(e) of U.S. Provisional Application 62/787,487, filed Jan. 2, 2019. The disclosure contained therein is incorporated by reference into this disclosure.

BACKGROUND OF THE INVENTION

This invention relates to belts of the type worn with slacks, trousers, jeans or shorts, and is more particularly concerned with a waist belt that is provided with contours directed inward in the thickness direction to provide support over concave portions of the human body.

A typical belt, made of leather, simulated leather, cloth, webbing or other material is configured to loop around the waistline of the wearer and fit within belt loops or belt tunnel that is provided in the outer bottomwear. Because there are concave portions of the wearer's torso at the waistline, there are corresponding gaps in the support provided by the waist belt, specifically at those places. That is, the human body has a concave zone or valley at or near the base of the spine, i.e., the small of the back, and two concave zones or valleys in front, at places to the right and left where the upper leg meets the abdomen. This means that the belt cannot give support at those regions because the belt does not fit the human contours properly, and often the pants, slacks, jeans, or shorts do not stay up, even when wearing a belt and tightening it; the wearer's shirt often pulls out from the pants waist and becomes un-tucked because of looseness in those areas. Also when worn tight enough to give adequate support, the belt is often not comfortable and the wearer can suffer from belly pinching. When the traditional waist belt is worn comfortably, the clothing may not fit properly.

Accordingly, the purpose of this invention is to solve the problem of improper fit especially in the areas around the concave body portions at the waistline.

OBJECTS AND SUMMARY OF THE INVENTION

Accordingly it is an object of this invention to provide a convenient and simple improvement to waist belts that resolves the drawbacks identified above.

It is a more particular object to provide a waist belt with raised contour supports on the inward side of the belt positioned strategically to correspond with the concave contours of the human body at the waistline, and to provide better and more comfortable support.

It is a specific object to provide an improvement on waist belts so that they fit the human body contours properly, so that the pants, trousers, jeans, slacks or shorts stay up and do not slip down, are worn comfortably without belly pinching, and keep shirts, blouses, and other top wear from pulling out of the pants waist and becoming untucked.

A yet further object is to provide a waist belt in which the belt contours can be removably attached, or can be adjusted to the particular wearer; or can be adjusted in both position and thickness for optimum fit.

In accordance with an aspect of this invention, a waist belt is formed of usual materials, e.g., leather, simulated leather, a tough plastic material, cloth, or webbing, as a generally flat strip that is configured to loop around the person's waist and fit into the usual belt loops or belt tunnel(s) provided at the waist of the trousers or other bottomwear that the person is wearing. Also a belt buckle or other equivalent fastening device can be provided to wear at the front and fastened the ends of the belt.

The waist belt is improved in that there is or are contour support portions included on the interior (body-facing) surface of the belt at the portions corresponding to the concave human body contours, e.g., at the small of the back, at the right and left front of the wearer, or at all three. The contours can be built-in, i.e., unitary with the belt at those places, or can be contour portions that are attached permanently or removably, to fit the specific wearer. The waist belt strap portion itself can have a width (vertical) of any of a variety of sizes, e.g. averaging perhaps ¾ to 1½ inches, but down to ⅜ inch or even ¼ inch for many women's fashion styles, and of a width of two inches or more for some belt styles. These would be chosen to fit within belt loop widths for the bottom wear in the person's wardrobe. The strap thickness may be ⅛ inch to provide strength and durability but also sufficient flexibility for the wearer.

The back contour support can be 2 to 8 inches long, favorably 4 to 6 inches long and tapered from its ends with a center thickness (depending on the wearer's dimensions) of ⅛ inch, ¼ inch, ½ inch, ⅜ inch, or, in some cases, up to a full inch. The front contour supports can be tapered to about ⅛ inch, ¼ inch, ⅜ inch, ½ inch or in some cases up to ¾ inch, and favorably 3 inches in length. These can be made of a material similar to that of the main belt strap, but may instead be made of a more yielding material, e.g., a flexible plastic foam that is somewhat stiff but sufficiently compressible to provide support with comfort, if desired. Also these may be cemented or sewn onto the belt, attached by a hook-loop fastener (e.g., Velcro), by metal clips or other system to maintain the contour support portions in the proper position to match the wearer's body contour. Favorably, the contour support portion may be adjustably positionable (e.g., using a Velcro system) for adjusting the waist belt to the individual user. Also, the contour support portions may be interchangeable to allow a thicker or thinner one to be used, if needed.

These and many other objects, features, and advantages of the waist belt of this invention will become apparent from the ensuing detailed description of a preferred embodiment, when read in conjunction with the accompanying Drawing.

DETAILED DESCRIPTION OF THE PREFERRED EMBODIMENT(S)

Figure 1:
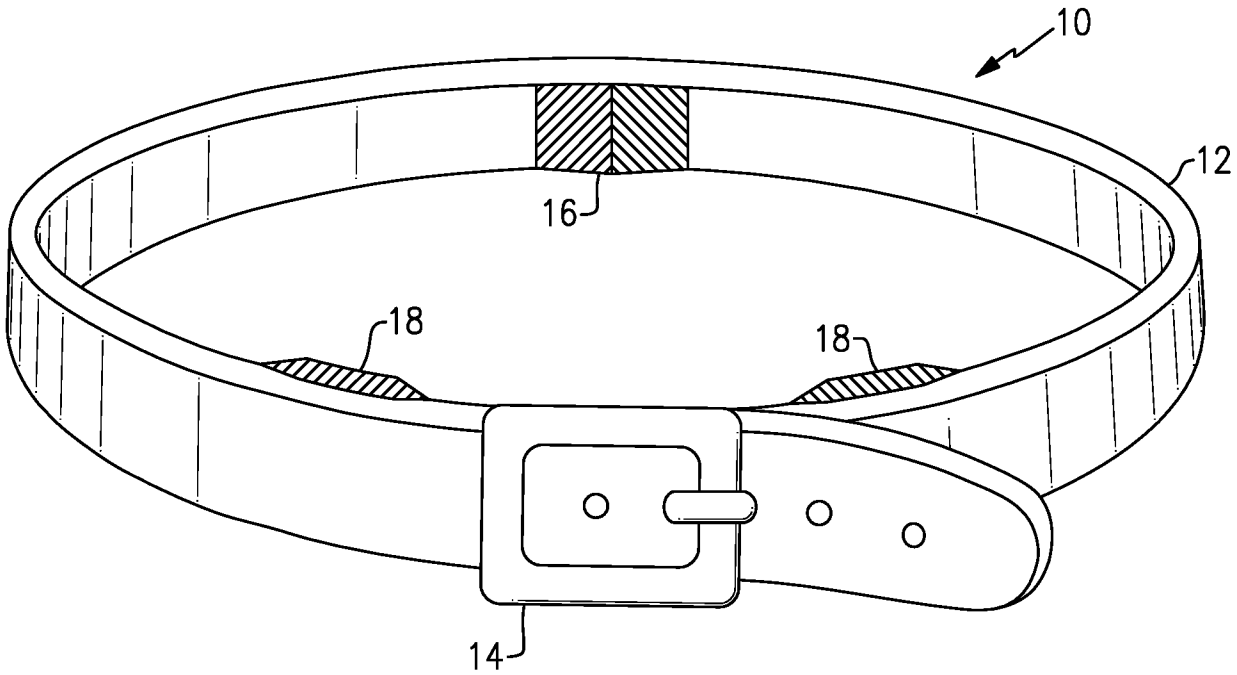
FIG. 1 is a perspective view of a waist belt according to an embodiment of this invention.
Figure 2:
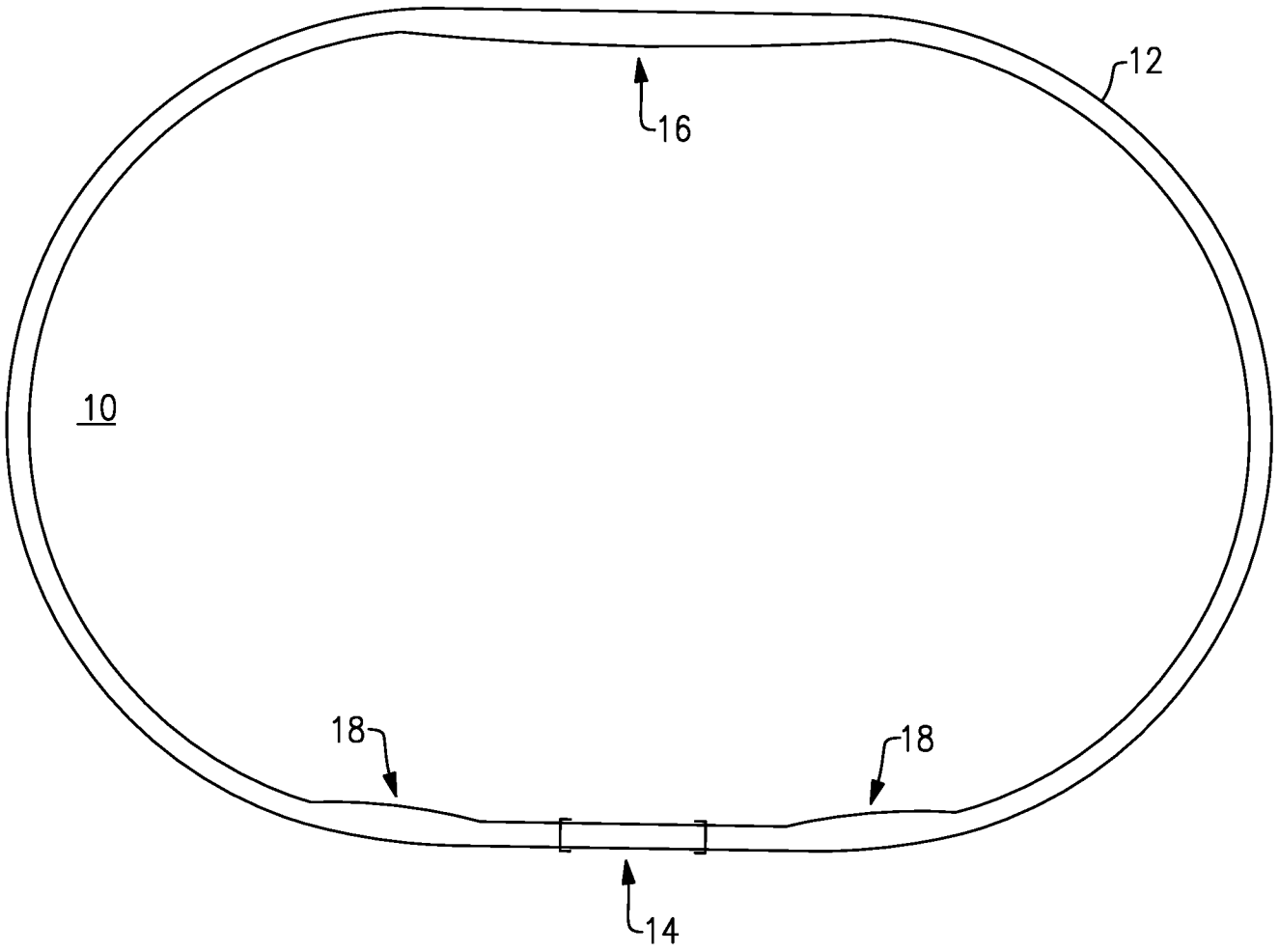
FIG. 2 is a top plan schematic view thereof.
Figure 3:
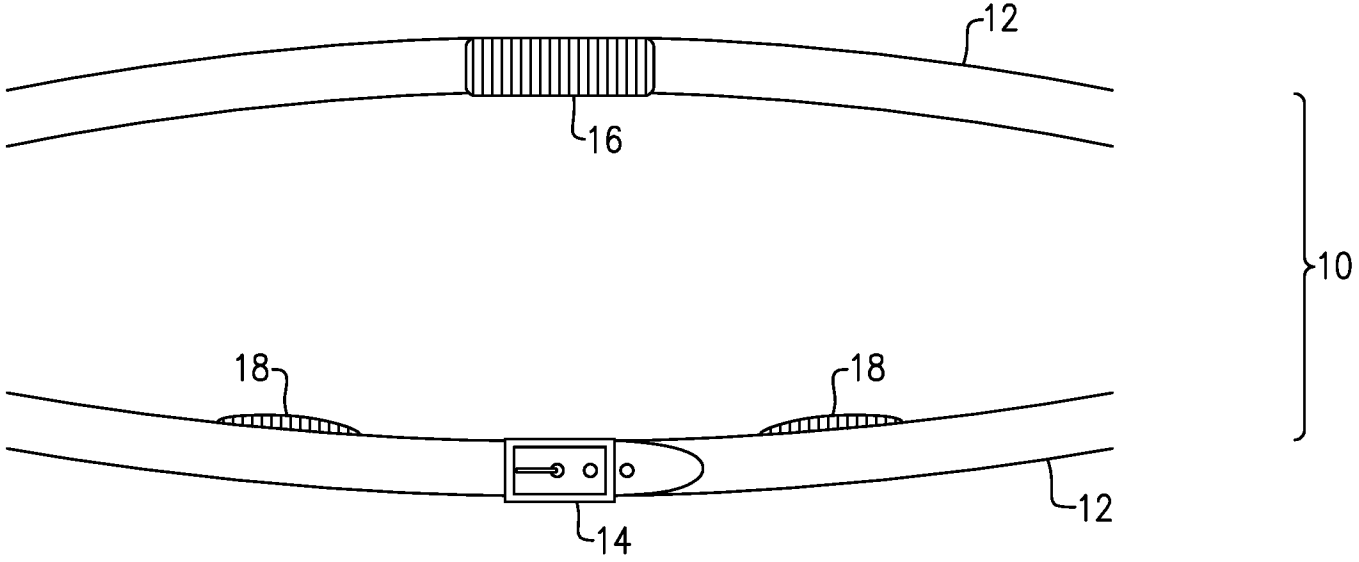
FIG. 3 is a perspective view of a similar embodiment featuring tapered contour support portions.

With reference to the Drawing, and initially to FIGS. 1 to 3, a waist belt 10 for use with men's or women's slacks, jeans, or other pants has an elongated strap 12 of a length sufficient to encircle the wearer's waistline with a buckle 14 or other closure device at one end to receive the free end of the strap 12. The strap 12 has a given width (i.e., vertical when worn) and thickness, the latter being e.g. ⅛ inch. The strap can be formed of conventional materials of sufficient flexibility and resistance to stretching. One particular buckle 14 is shown here as an example but any suitable closure device could suffice.

As shown here, there is a rear contour support 16 positioned at about the mid-point of the belt so that when the belt is worn the contour support 16 is positioned at the small or valley of the wearer's back, i.e., approximately aligned with the spine. This can have tapered ends in the longitudinal direction, and thickness that varies to about a half inch, more or less, (i.e., between ⅛ inch and ¾ inch, in some cases up to one inch) dimensioned as needed for the particular wearer, as the recess in the wearer's body shape at that point varies from one person to another. There are also two front contour supports 18, 18 located towards the buckle end and the free end of the belt strap 12, so that when worn these contour supports 18, 18 are located at the valleys or concave curvatures at the right and left of the wearer's center at his or her waist line. These contour supports 18, 18 can favorably have a tapered geometry with a thickness in the range of the rear contour support 16.

The contour supports may be of a material similar to what is used in the belt strap 12, or may be a stiffer or softer material, e.g., a durable resilient plastic resin or plastic foam. These contour supports 16, 18 may be sewn in place, cemented, or riveted to the strap 12. Alternatively, these may be re-positionably attached, e.g., using buttons, metal clasps, or hook-loop fastening material. Favorably, these may have gently tapered end portions leading to a constant-thickness center portion. Alternatively, as shown in FIG. 3, the supports 16, 18 may have an arcuate, rounded profile over the length thereof.

Figure 4:
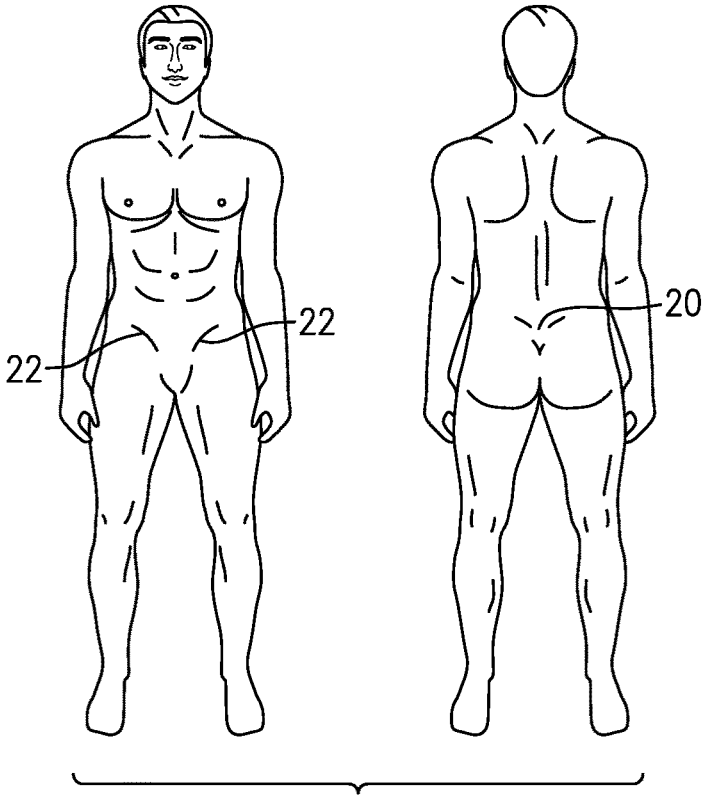
FIGS. 4 and 5 are front and rear views to illustrate the concave or valley portions of the human contour at the waist line or belt line for male and female torsos, respectively.
Figure 5:
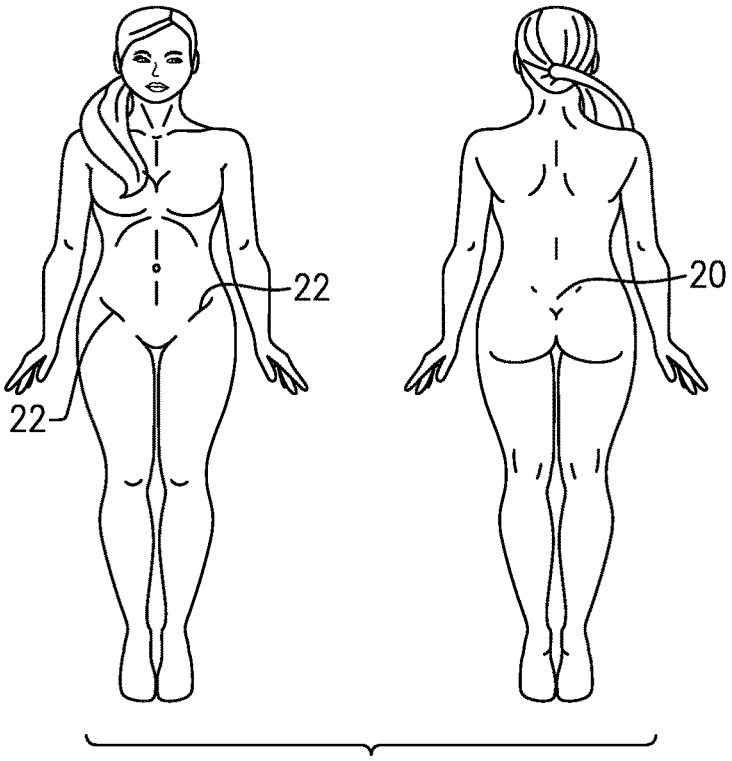

FIGS. 4 and 5 show front and back views of a human waist and torso, and indicate on each the rear side valley or recess 20 near the bottom of the spine, and the two front valleys or recesses 22 at approximately the location of where the torso meets the respective upper leg. These are the locations at which the counter supports 16 and 18 are to be positioned when the belt is worn.

In one process of constructing the belt of this invention, the starting material for the strap portion 12 can be a length of the belt material of the desired width, e.g., 1⅛ inch, The locations for the contour supports 16 and 18 are determined, and then excess material is removed to leave the supports 16, 18 as thicker portions located as determined by measuring the wearer at his or her waistline. For added support, a layer of resilient foam may be added at the locations of the contour supports.

The color, style, size and material of the belt may be selected as desired, and any buckle or closure may be employed.

A belt may be constructed with only the rear contour support 16, or with only the front contour supports 18, for a given belt and a given wearer.

It is also possible to place one or more of the contour supports 16, 18 directly onto the waistband of the pants or trousers, in which case any conventional belt can be used with those articles. These may be sewn in place, or removably positioned.

The invention is not limited to the foregoing embodiments, and many modifications and variations are possible without departing from the main concept. Rather the scope of this invention is defined in the appended claims.

What is claimed is:

1. A waist belt with one or more contour support portions shaped so as to conform to natural contours of the human body, said natural contours including at least a back concave recess at the location of the spine of the wearer and at least left and right concave recesses located to the left and right of the front center of the wearer; the waist belt comprising:

an elongated strap portion adapted for encircling the waist of a human wearer, having a length sufficient at least to encircle said waist and extending between a buckle and a tongue, a width in the vertical direction when worn, and having a predetermined thickness and having an inner side surface facing the wearer when the belt is being worn;

at least one contour support member affixed onto the inner side surface of said elongated strap and positioned so as to provide support at least at the location of at least one of said concave recesses, each said contour support member including a portion that extends in an inward direction from the inner side surface of said strap portion at a location corresponding to the location of a respective one of said concave recesses when the belt is being worn and extending along the strap portion for a limited distance that is substantially within the corresponding one of said natural contours; and wherein said at least one contour support member includes a back contour support member provided at a middle location on said strap portion substantially midway between said buckle and said tongue, and is adapted and positioned to fit the shape of the back concave recess and to support the back concave recess of the wearer, and said back contour support member has a length of two to eight inches and a thickness of between one-eighth inch and one inch at the middle location of said strap portion and is configured to fit within the center of said back concave recess.

2. A waist belt according to claim 1 wherein said back contour support member has tapered ends and a mid portion of substantially constant thickness.

3. A waist belt according to claim 1 wherein said back contour support member has an arcuate profile that follows the contour of the back concave recess of the wearer.

4. A waist belt according to claim 1 wherein said back contour support member is affixed in place on said strap portion.

5. A waist belt according to claim 1 wherein said back contour support member is removably attached onto said strap portion, and is configured to be adjustably positioned thereon.

6. A waist belt according to claim 1 wherein said belt includes left and right contour support members that are provided at a respective locations near ends of said strap portion and are respectively positioned to support the left and right concave recesses of the wearer.

7. A waist belt according to claim 6 wherein said left and right contour support members have a length of two to four inches and a thickness of between one-eighth inch and one inch.

8. A waist belt according to claim 7 wherein said left and right contour support members have tapered ends and a mid portion of substantially constant thickness.

9. A waist belt according to claim 7 wherein said left and right contour support members each have an arcuate profile configured so that it follows the contour of the respective concave recess of the wearer.

10. A waist belt according to claim 6 wherein said left and right contour support members are affixed in place on said strap portion.

11. A waist belt according to claim 6 wherein said left and right contour support members are removably attached onto said strap portion, and are configured to be adjustably positioned thereon.

12. A waist belt according to claim 1 wherein said at least one contour support member is formed of a compressible resilient material.

13. A waist belt with one or more contour support portions shaped to conform to a natural contour of the human body, said natural contour including at least a back concave recess at the location of the spine of the wearer and extending for a given width, said waist belt comprising:

an elongated strap portion adapted for encircling the waist of a human wearer, having a length sufficient at least to encircle said waist, a width in the vertical direction when worn, and a predetermined thickness, and having an inner side surface facing the wearer when the belt is worn;

at least a back contour support member affixed onto the inner side surface of said elongated strap and positioned so as to provide support at the location of said back concave recess, said back contour support member extending inward at a mid-location of the elongated strap portion corresponding to a location of the wearer's spine, and extending along the belt strap portion for a limited distance corresponding to the width across the back concave recess when the belt is being worn.

14. A waist belt according to claim 13 wherein said back contour support member has a length between two and eight inches centered on a mid-location of said strap portion corresponding to the position of the wearer's spine.

15. A waist belt according to claim 14, wherein the back contour support member has a midportion and tapered end portions that taper from an end of said mid-portion down to the inner side surface of said elongated strap portion.

16. A waist belt according to claim 15, wherein said back contour support member is configured so as to be adjustably positionable at said mid-location of said elongated strap portion.

* * * * *